US005649404A

United States Patent [19]

Reinklou

[11] Patent Number: 5,649,404

[45] Date of Patent: Jul. 22, 1997

[54] BEAM ANCHORING DEVICE

[75] Inventor: Lars-Anders Reinklou, Nälden, Sweden

[73] Assignee: Combisafe International AB, Ostersund, Sweden

[21] Appl. No.: 676,170

[22] PCT Filed: Jan. 13, 1995

[86] PCT No.: PCT/SE95/00024

§ 371 Date: Aug. 14, 1996

§ 102(e) Date: Aug. 14, 1996

[87] PCT Pub. No.: WO95/19474

PCT Pub. Date: Jul. 20, 1995

[30] Foreign Application Priority Data

Jan. 14, 1994 [SE] Sweden ..... 9400087

[51] Int. Cl.[6] ..... E04B 1/58

[52] U.S. Cl. ..... 52/698; 52/766; 24/522; 248/228.2; 248/231.31

[58] Field of Search ..... 52/698, 703, 766, 52/729.1, DIG. 8; 24/459, 522, 526; 248/316.2, 228.1, 228.2, 231.31

[56] References Cited

U.S. PATENT DOCUMENTS

| | | | |
|---|---|---|---|
| 166,022 | 7/1875 | Mihills . | |
| 888,931 | 5/1908 | Robinson . | |
| 1,000,389 | 8/1911 | Ette . | |
| 1,154,916 | 9/1915 | Evans . | |
| 1,506,442 | 8/1924 | O'Hara . | |
| 1,571,230 | 2/1926 | Bohn . | |
| 1,898,725 | 2/1933 | Hamilton . | |
| 2,464,225 | 3/1949 | Graham . | |
| 2,491,638 | 12/1949 | Ayers . | |
| 2,886,370 | 5/1959 | Liebert | 52/698 X |
| 4,646,452 | 3/1987 | Mazzurchelli | 24/522 X |
| 4,676,687 | 6/1987 | Koffler . | |
| 4,700,917 | 10/1987 | Dillman . | |
| 4,825,609 | 5/1989 | Rundo | 52/766 X |
| 5,024,037 | 6/1991 | Ono . | |
| 5,546,724 | 8/1996 | Reinklou . | |

FOREIGN PATENT DOCUMENTS

WO93/15285 8/1993 WIPO .

*Primary Examiner*—Lanna Mai
*Attorney, Agent, or Firm*—Young & Thompson

[57] ABSTRACT

A lock-wedge bracket (10) is intended to straddle a beam and can be mounted at any desired position on the beam. It comprises a short leg (12) and a long leg (14), forming a 90° angle with each other. An angle flange (16) on the leg (12) is bent 90° and the outer edge of the leg (14) is bent over approximately 105°. A wedge (23) and a hook (29) with a lip (31) are disposed in a slot in the leg (14). The distal end of the leg (14) thereby acts as a pressure spring (18) for resilient pressing of the wedge against the hook, which in turn is brought into engagement with the lip (31) under the lateral edge of the beam.

4 Claims, 2 Drawing Sheets

BEAM ANCHORING DEVICE

BACKGROUND OF THE INVENTION

The invention relates to a device of the type disclosed in the preamble to the attached claim 1.

WO 93/15285 reveals as previously known a beam anchoring device of the above mentioned type, comprising a lock-wedge bracket intended to straddle e.g. an I-beam, and which is mountable in any position on the beam. Said bracket has a short leg and a long leg, forming a 90° angle to each other. A flange on the short leg is angled 90° and the outer edge of the long leg is bent essentially 105°. The latter thus acts as a spring to force a locking wedge against the lateral edge of a beam.

The known beam anchoring device more than fulfills the safety requirements applying in the building industry, e.g. for use as a bracken for posts for protective railings on both horizontal and vertical beams or for connecting two cross beams to each other, thereby using two brackets with their outer surfaces joined to each other.

In certain cases it can, however, be desirable to fulfil even higher requirements. One example thereof is when the bracket is to be loaded by forces in varying directions. This occurs, for example, if the bracket is used to anchor posts for a protective railing, separating two work areas from each other, e.g. for concrete casting. Another example is when the railing is to be mounted on beam ends projecting from the edge of a floor structure, and it is desirable to also take up forces acting in the longitudinal direction of the railing, or wind loads acting on the railing, regardless of how the bracket has been oriented when mounted on the beam.

SUMMARY OF THE INVENTION

A purpose of the invention is therefore to achieve a bracket of the above mentioned type, with which it is possible to absorb substantially greater bending moment than previously from a post welded to the bracket, for example, said moment acting from the wedge towards the post.

This purpose is achieved by a bracket of the type described by way of introduction which has the characterizing features disclosed in the attached claim 1. Advantageous further developments and improvements of the invention are disclosed in the subclaims.

BACKGROUND OF THE INVENTION

The invention will be described below in more detail with reference to the accompanying schematic drawings. Similar components will have the same reference numerals in the different figures.

DETAILED DESCRIPTION OF THE INVENTION

Figure 1:
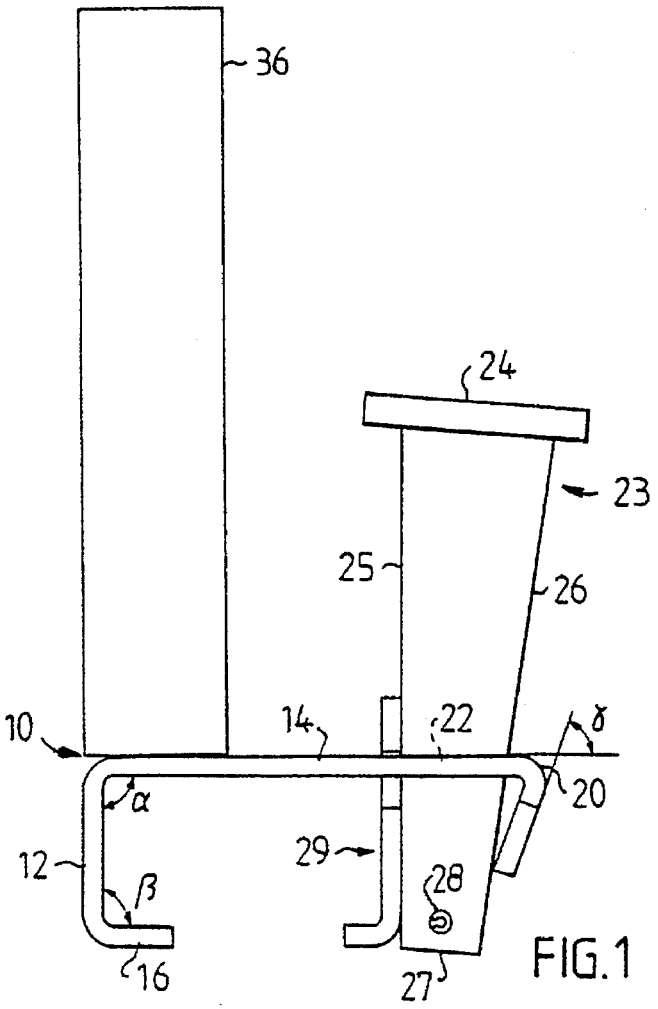
FIG. 1 shows a vertical view of the bracket as seen from one end.
Figure 2:
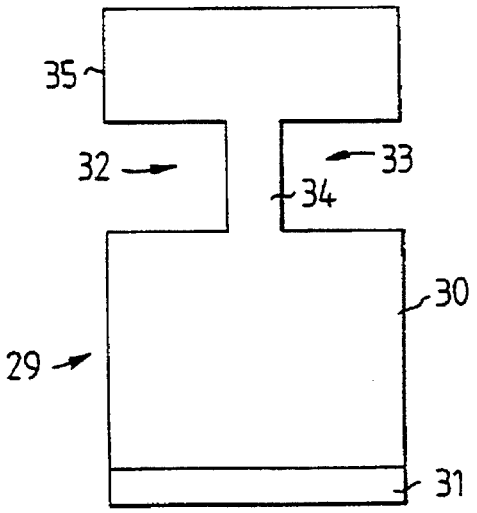
FIG. 2 shows a vertical view of a hook belonging to the bracket.
Figure 3:
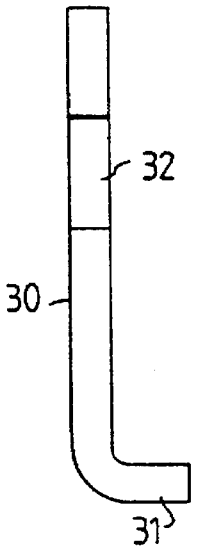
FIG. 3 shows the hook shown in FIG. 2, in section.
Figure 4:
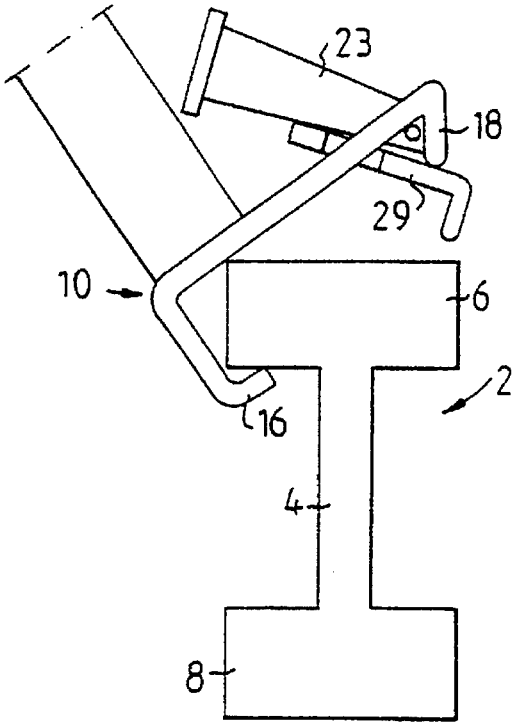
FIG. 4 shows the mounting of the bracket on an I-beam.

Similar to what is described in WO 93/15285, an I-beam 2 has a web 4, an upper flange 6 and a lower flange 8, on which beam a lock-wedge bracket 10 is to be anchored. The lock-wedge bracket comprises a first short leg 12 and a second long leg 14, which are joined to each other forming an angle α. The distal ends of the legs are each bent predetermined angles β and γ, respectively, thus forming an angle flange 16 and a pressure spring 18, respectively. Both the angle γ and the angle β are preferably 90°, while the angle γ is preferably within the range 70°–75°. A rounded ridge 20 is thereby formed on the distal end of the long leg 14. A slot 22 runs essentially longitudinally to the long leg from the ridge 20 substantially half the length of the leg approximately along the centerline of the long leg 14. The slot is made so that a wedge 23 is freely movable therein between two end positions. The wedge has a hammer plate 24, two lateral edges 25,26, a wedge point 27 and a lock pin 28. Freely movable within the slot there is also a hook 29 which has a body 30 and a lip 31 extending substantially perpendicular from the lower end of the body. The upper half of the body has notches 32 and 33, creating an intermediate web portion 34 joining a yoke 35 formed in the upper end of the body to the lower half of the body 30. The hook 29 is located between the wedge 23 and the short leg 12. The lip 31 of the hook is directed towards the angle flange 16 of the short leg 12. Suitable dimensions for the bracket are 42 mm between the long leg 14 and the angle flange 16, a distance between the first leg 12 and the body 30 of the hook 29 in the interval 78–82 mm, and a distance between the second leg 14 and the lip 31 of the hook of about 42 mm. The lip of the hook extends about 10 mm and the distance between the underside of the yoke 35 and the lip is approximately 47 mm. The notches 32 and 33 mirror each other and have an upper limit of about 15 mm from the top of the body (the yoke 35) and extend longitudinally along the body to a lower limit circa 30 mm from the upper end of the body. The hook has a width of about 40 mm and a thickness of the components of essentially 5 mm. A post sleeve 36 is welded normal to the second leg 14, essentially between the short ends of the bracket, and is located opposite the angle flange 16.

To mount the bracket, the leg 12 is first hooked with the angle flange 16 over one side edge of the beam flange 6. The bracket is then placed so that the second leg 14 is parallel to the topside of the flange 6. During this process, the wedge is in its extracted position so that the lock pin 28 is in contact with the corner between the second leg 14 and the pressure spring 18, making it possible for the hook to be swung out so that its lower half is in contact against the pressure spring 18. When the bracket is in place on the beam, the wedge 23 is driven down so that it is pressed against the outside of the hook, whereby the hook, by the spring effect of the pressure spring 18 is pressed against the other lateral edge of the beam flange 6. Thus, the lip 31 of the hook is brought into engagement with the underside of the beam flange. The angle flange 16, the two legs 12,14 and the hook 29 with the lip 31 thus grip the beam flange forming a structure similar to a box girder.

When the bracket is to be removed, the wedge is loosened by being driven upwards, for example by hitting the plate 24 from below with a hammer or by pulling out the wedge with the edge of a hammer claw or crowbar, as is described in WO 93/15285.

Figure 5:
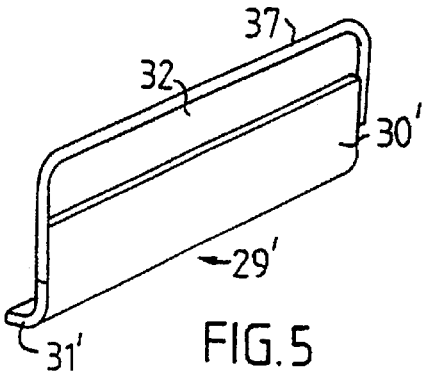
FIG. 5 shows a variant of the hook, in perspective.
Figure 6:
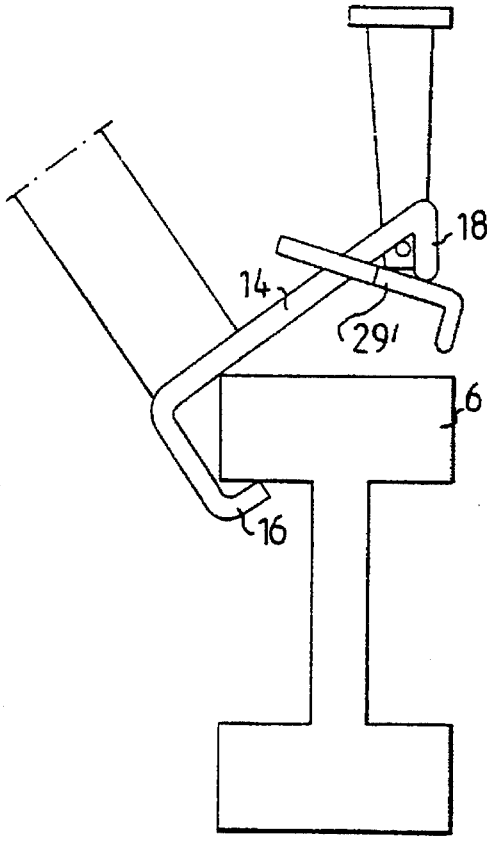
FIG. 6 shows the bracket with the hook of FIG. 5, during the mounting of an I-beam.

According to an additional embodiment, shown in FIG. 5, the hook 29' has a single slot 32' located adjacent the upper end of the hook, having a width of circa 200 mm and extending over essentially the entire width of the hook. The slot is suitably made by means of a round rod of diameter 6 mm, which is bent to form a yoke 37, the legs of which are suitably welded to the body 30' of the hook. At its lower end, the hook 29' has, as does the hook 29, a lip 31' extending substantially 90°. The hook 29' is placed on the bracket 10 with the second leg 14 located in the slot 32' The bracket with the hook 29' is attachable and removable in a manner similar to that described for the hook 29.

When setting up a protective railing along the edge of a floor structure 10 m above the ground in an urban environment, the construction code prescribes that the railing must withstand a wind lead computed according to the rules BFS 1988:18,6:2 for new construction. According to this computation, each bracket must withstand a lead due to wind corresponding to a force of 317 N acting horizontally, from the anchoring plane 0.78 m up on the protective railing. It is possible to mount each bracket with the angle flange 16 located on any side of the beam flange 6 by using the hook 29 suggested according to the invention, whereby the bracket will withstand the prescribed wind lead on both the "hookside" and the "angle flange side".

The bracket can be used for all of the uses disclosed in WO 93/15285 with increased flexibility, since the hook thus makes it possible to mount the bracket at any desired orientation on a beam without affecting appreciably the stability of the bracket, regardless of the direction of the force acting on it. The hook also prevents the wedge from coming into direct contact with the beam, thus distributing the load over a larger surface. A wooden beam, for example, will not be damaged by the wedge. By the engagement of the hook with its lip on the underside of the beam flange and by virtue of the fact that the hook separates the wedge from the beam, the wedge is prevented from coming loose due to jerking the lock-wedge bracket back and forth on the beam.

Finally, it is pointed out that the present invention is not considered to be limited to the above described special embodiments. Rather, the invention comprises all those embodiments and equivalent solutions falling within the scope of the attached claims.

I claim:

1. Device for anchoring beams to each other or to other construction elements comprising a bracket which is mountable in any desired position on at least one of the beams, said bracket being disposed to straddle like a yoke the beam in its mounted position, and comprising a first and a second leg, which form an essentially right angle with each other and are bent over at their respective distal ends to form predetermined angles $\gamma$ and $\beta$, respectively, an angle flange (16), which is formed on one of the legs (12), and a lock means (23,29) which is arranged in a slot (22) in the second leg (14), said first leg (12) abutting in the mounted position against the opposite side of the beam from the lock means, at the same time as the angle flange (16) abuts against a side of the beam which faces away from the slot (22) in the second leg, characterized in that the lock means comprises a wedge (23) and a hook (29), which, when the bracket (10) is in its mounted position, can be operated to individual positions, in which one (25) of the opposite sides of the wedge (23) is in contact with the hook (29), which in turn is in contact with a side of a flange (6) of the beam (2), and in which the other (26) side of the wedge abuts against the distal end of the second leg (14) bent over in the form of a pressure spring (18), and that the bracket, by means of the angle flange (16), the first and second legs (12,14) and the hook (29), grip the beam flange (6) like a box profile.

2. Beam anchoring device according to claim 1, characterized in that the hook (29) has an essentially L-shaped profile with a body (30) and a lip (31), and that the hook as seen in plan view has at least one notch (32,33) of predetermined shape.

3. Beam anchoring device according to claim 1, characterized in that the hook (29) has two notches (32,33) and a midportion (34) located between the notches, which passes, with a predetermined play, into the slot (22), and that the shape of the notches permits the hook to be swung out into abutment against the pressure spring (18).

4. Beam anchoring device according to claim 3, characterized in that the hook has a yoke (35), which, in the mounted position of the bracket (10), rests against the outside of the second leg (14) at the same time as the lip (31) of the hook is in contact with the underside of the beam flange (6).

* * * * *